US007297093B2

(12) United States Patent
García López

(10) Patent No.: US 7,297,093 B2
(45) Date of Patent: Nov. 20, 2007

(54) DEVICE FOR THE PRACTICE OF EXERCISES, SPORTS, GYMNASTICS AND DIFFERENT ACTIVITIES THAT JOIN TECHNIQUES, CONCEPTS AND THEORIES FROM WEST AND EAST RELATED TO EXERCISE, SPORTS AND HEALTH

(76) Inventor: Gaspar Jorge García López, Paseo de Colombia No. 172-A, Las Cumbres, Blviria, Marbella, Málaga (ES) 29600

( * ) Notice: Subject to any disclaimer, the term of this patent is extended or adjusted under 35 U.S.C. 154(b) by 59 days.

(21) Appl. No.: 11/202,727

(22) Filed: Aug. 11, 2005

(65) Prior Publication Data

US 2006/0073955 A1 Apr. 6, 2006

(30) Foreign Application Priority Data

Oct. 1, 2004 (ES) ..... 200402346

(51) Int. Cl.
*A63B 21/00* (2006.01)

(52) U.S. Cl. ..... 482/124; 482/121; 482/126

(58) Field of Classification Search ..... 482/124, 482/121, 105, 74

See application file for complete search history.

(56) References Cited

U.S. PATENT DOCUMENTS 866,495 A 9/1907 Marks
4,685,671 A 8/1987 Hagerman et al.
5,176,377 A * 1/1993 Wilkinson ..... 482/120
5,813,955 A * 9/1998 Gutkowski et al. ..... 482/124
6,120,422 A 9/2000 Kiemer
6,517,470 B1 2/2003 Chak et al.
6,840,894 B2 1/2005 Lerner

OTHER PUBLICATIONS

JumpUSA.com Website, "The Power Sports Trainer," 2 pages (printed Mar. 16, 2006).

* cited by examiner

*Primary Examiner*—Jerome Donnelly
(74) *Attorney, Agent, or Firm*—Intellectual Property Law Group LLP; Otto O. Lee; Juneko Jackson

(57) ABSTRACT

Device for practicing exercises, sports, gymnastics and different physical activities, which join various techniques and concepts of eastern and western theories related to exercise, sports, and health; such a device comprising of a belt adjustable to the abdomen region of the user, which incorporates a sliding component with an optional blocking system to be crossed by two elastic straps of adjustable length, each strap having at the end a removable fastening system for the extremities of the user.

19 Claims, 5 Drawing Sheets

DEVICE FOR THE PRACTICE OF EXERCISES, SPORTS, GYMNASTICS AND DIFFERENT ACTIVITIES THAT JOIN TECHNIQUES, CONCEPTS AND THEORIES FROM WEST AND EAST RELATED TO EXERCISE, SPORTS AND HEALTH

FIELD OF THE INVENTION

The present invention refers to a device for exercises, sports, gymnastics and various activities that join Eastern and Western techniques, concepts, and theories related to exercise, sports and health.

BACKGROUND OF THE INVENTION

At the present time western health culture is based, in large part, on the elimination of stress, the fulfilment of prevention exams, the maintenance of healthy nutrition, and actively, the practice of exercise and gymnastics.

Especially in the West, this kind of exercise or gymnastics practice is focused on three areas: muscular exercise, aerobic exercise (cardiovascular), and stretching.

On the other hand, eastern health culture gives equal significance to the body, mind, emotions and spirituality in addition to integrating all of them, the (body, mind, and soul), toward this end using concepts, theories, techniques and skills like traditional Chinese medicine, Tai Chi Chuan, Qigong or Yoga, in which the balance between body, mind and spirit, is intended with a sense of aesthetic and an energy interchange in order to achieve the balance between Ying and Yang which provides peace and health. These concepts, theories and arts are applicable to any kind of sport, exercise or daily activity.

The device of the present invention intends, therefore, to facilitate, improve and optimize the practice of exercises, sports, gymnastics or other activities (calligraphy, dance, and theatre, among others) by joining concepts and theories of both cultures and by providing the individual that uses the device with the advantages of both cultures, as it is not currently known that any other devices would serve the same purpose.

SUMMARY OF THE INVENTION

The device of the present invention is for the practice of exercises that joins techniques, concepts and theories of the West and of the East in relation to exercise, sports and health; that joins the western gymnastics technique that focuses on muscular exercise, aerobics, and stretching with the eastern technique which works properly with relaxation, concentration, breathing, and the corporal position, as well as biodynamic and energetic flow; combined with the stimulation of the acupunctural and energetic channels of the body and of the groin area, the meditation in motion and the promotion and development of the "Dan Tien" (energetic Centre developer of strength and gravity of the body situated beneath the navel).

The device is used by means of specific exercises, or during the development of any kind of activity, sport or exercise; achieving a greater training for muscular and aerobic strength, a better comprehension of the centre of gravity and the development of strength in the user situated at the lower abdomen, a coordination between the lower and higher parts of the body as well as of the upper and lower limbs and an integration of the whole body, physically and emotionally for better performance and use of training time, as well as the activation of energetic centres, channels and meridians. All of the above functions as facilitated by the device, improve the performance of the specific activity or sport engaged in as well as the health, well-being, and physical and psychological equilibrium of the user.

In addition, the device of the present invention can be used in conjunction with the practice of any kind of sport or activity of western or eastern inspiration. Examples of such sports and activities include aerobics, step, walking, jogging, golf, baseball, tennis, disco, weight, javelin, dance, aquatic, martial arts: Karate, Kung Fu, Tae Kwon Do, Judo, Tai Chi Chuan, Aikido, boxing and so forth.

According to the invention, the device comprises a belt that is firmly adjusted to the user's waist in the abdomen region, which helps to avoid inguinal hernia, protects the lumbar zone, and creates a consciousness of the middle torso area, which is indispensable to promote during the performance of the exercise or practice facilitating the development of inherent benefits, for example, greater strength, among other things.

The belt of the device comprises a component for the sliding passage of two straps at the center of gravity of the user, which is the strength-generating and energy-interchanging zone of the lower abdomen. The ends of the straps are fixed to the extremities of the user, preferably at the ankles and wrists, to facilitate coordinated movement.

The movement of the straps through the sliding component can be blocked to achieve the independent exercise of the user's extremities.

The straps are elastic and are adjustable in length in order to adapt to the size of the user or to the exercise or sport to be practiced. As a result, the stretching of the straps during exercise or the activity is possible regardless of whether the sliding component, situated at the belt, is blocked or not; consequently, the extremities can be either independent from or related to each other.

The straps will be fastened to the users extremities in a comfortable fashion. All the materials used that are in contact with the skin are hypoallergenic and preferably natural.

There are several functional possibilities of the device depending on different combinations in arrangement of the straps with regard to each of the extremities and depending on the different objectives and benefits to be achieved. One of these possibilities consists in crossing the straps relating the inferior left extremity (ankle) with the superior right one (wrist), and vice versa with the other strap. The device functions as well without crossing the straps by relating the superior and inferior extremity of the same side with each of the straps. Another possibility consists in connecting with one strap the inferior extremities and with the other strap the superior ones. Further, another possibility, as mentioned before, consists of immobilizing the straps in order to make the extremities independent during exercise. The preferred way of using the straps of the invention involves placing the sliding passage component at the front part of the body, although it can also be used on the back side of the body as well at the same height as the torso level previously mentioned, thereby with the strings passing through the back side of the body (behind the torso—back—and behind the and legs).

DETAILED DESCRIPTION OF SPECIFIC EMBODIMENTS OF THE INVENTION

Figure 1:
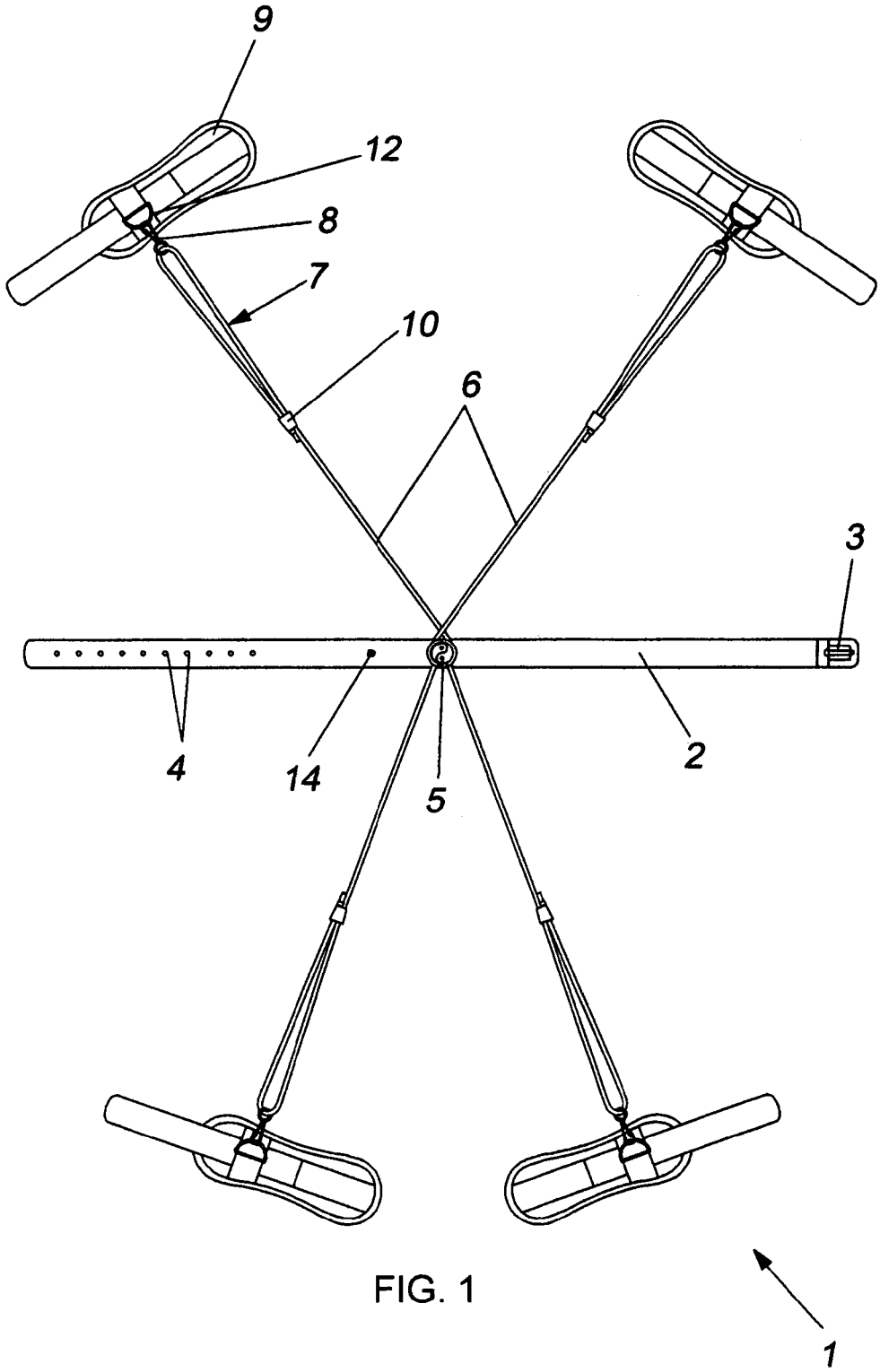
FIG. 1 shows a view of a preferred embodiment of assembly of the device of the present invention.

The device 1 of the invention comprises a belt 2 preferably around 4 cm wide, which is adjusted to the user's waist beneath the navel, and is provided with a belt buckle 3 and buttonholes 4 to be adjusted at a maximum. The belt is preferably composed of natural hypoallergenic materials, for instance leather.

On the belt, in the area of the lower abdomen, a piece 5 of sliding passage component which can be optionally blocked is fixed, for two elastic straps 6 that extend at their ends in curls 7 provided with hooks 8 for detachably fixing with the removable small cushion 9 which can be fastened to the ankles and wrists of the user. There is an economical way of producing the invention in which the hooks are not required when the cords are directly fixed to the small cushion.

The thickness of the straps 6 can vary, and can vary from approximately 7 to 12 millimetres, with a length of approximately 1.80 metres. The thickness of the straps will influence their elasticity and therefore the level of training, allowing for higher or lower muscular and aerobic training, as well as other characteristics of the invention The length of the straps is adjustable so that the straps can adjust to the size of the user and also influence the training effort by a lengthening or shortening of the straps. The adjustment is made by means of buckles 10 which also define the ends of corresponding curl 7.

On the other hand, the small cushions 9 are made up of natural and hypoallergenic materials, preferably incorporating a soft stuffing which minimizes the traction made by wrists and ankles. These small cushions integrate a belt 11 to be fixed to the joint by an adhesive (fastener) base, and a ring 12 on which is fixed the corresponding hook 8, or directly the corresponding curl at the end of the cord.

Piece 5 is made up of a case 13 internally threaded with a blind bottom 5*a*, projecting out perpendicularly of the external side 14 of the belt. This case is provided with holes 15 on the perimeter for an easy passageway for the straps 6, which will be able to slide freely through them and on some channels 5*b* inserted in the blind bottom of the case which assist in their movement. Threading till the end a threaded piston rod 16, will strangulate the straps impeding their movement through the interior of the case, the straps will be immobilized, as they are trapped against the bottom of the channels 5*b*; or loosening the threaded piston rod a bit without removing it completely will permit the free movement of the straps for use with the various techniques previously mentioned.

Figure 2:
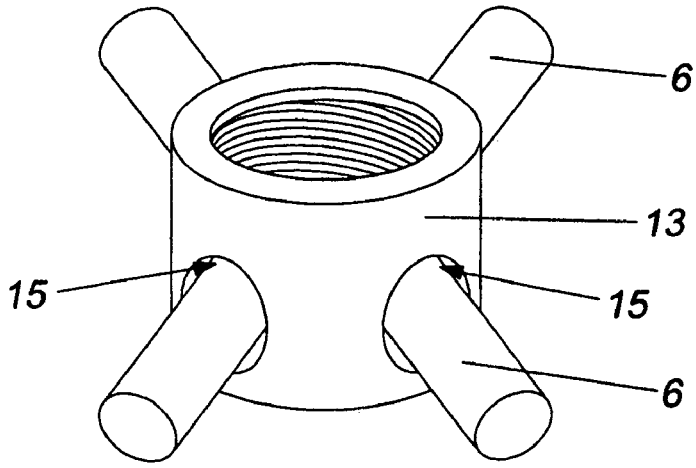
FIG. 2 shows the details of the casing for the sliding passage component of the straps for the device of the present invention.
Figure 3:
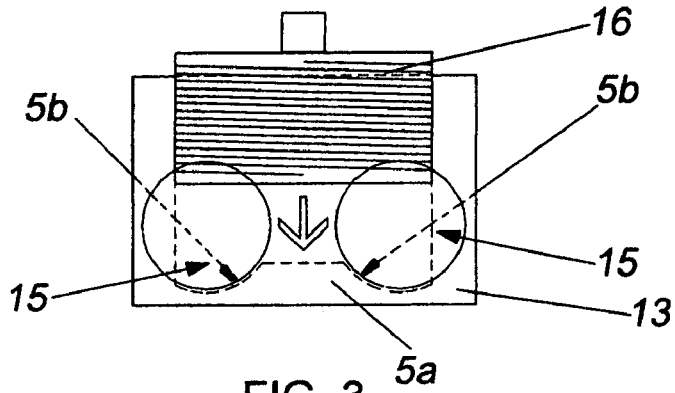
FIG. 3 shows a schematic lateral view of the sliding passage component of the straps for the device of the present invention.
Figure 4:
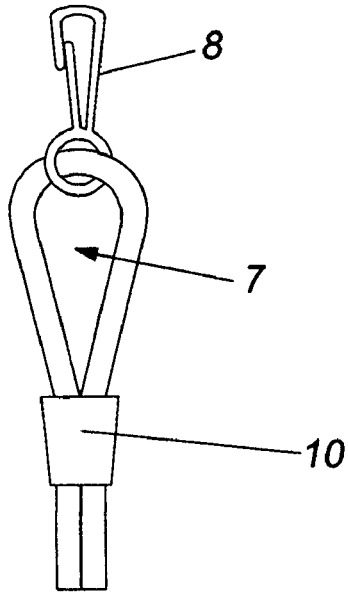
FIG. 4 shows a detailed view of the extremities of the straps, the curl and the hook to which a small cushion is fixed.
Figure 5:
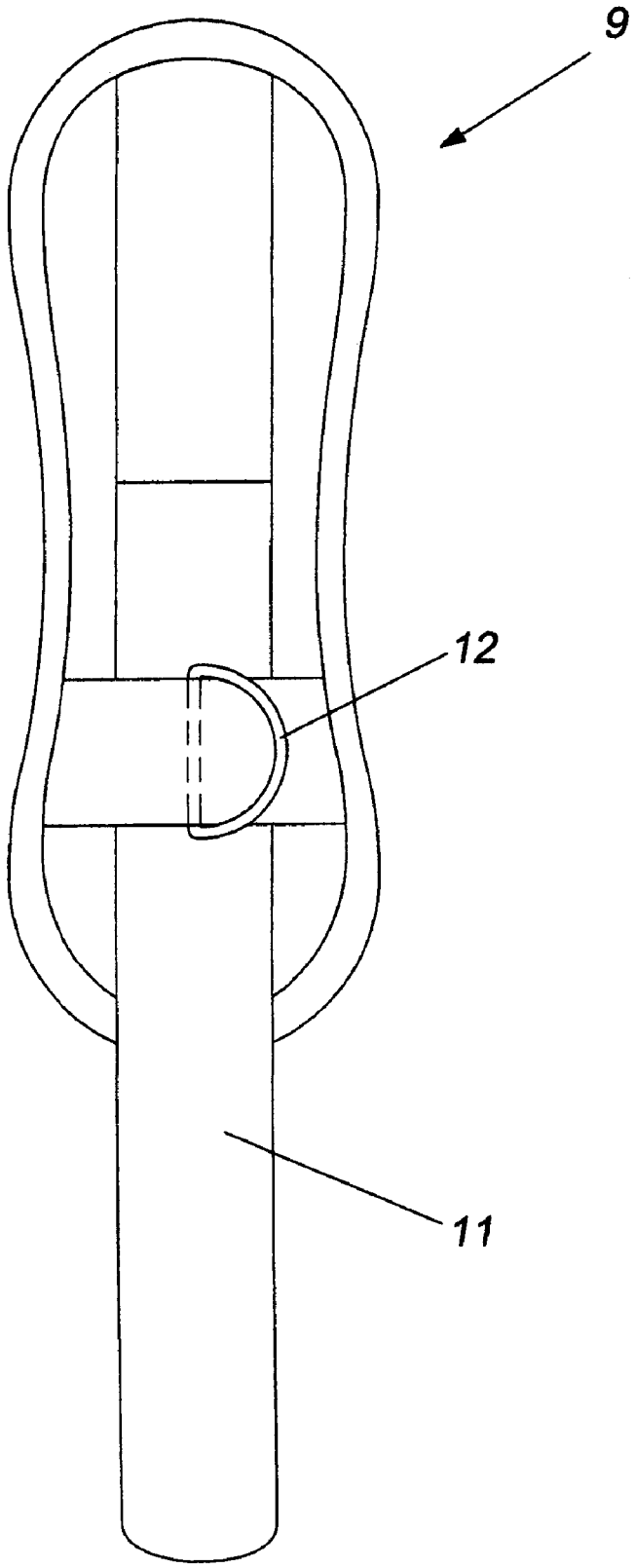
FIG. 5 shows a detail of one of the small cushions that are fixed to the limbs of the user.

The case will preferably have four holes on the same level with regard to its axis, situated close by pairs in a lower and upper sense and with the straps sliding in this instance in parallel through the interior of the case. In the situation they cross each other, they will do so at the upper exterior part of the case as shown in FIGS. 1 and 2.

Figure 6:
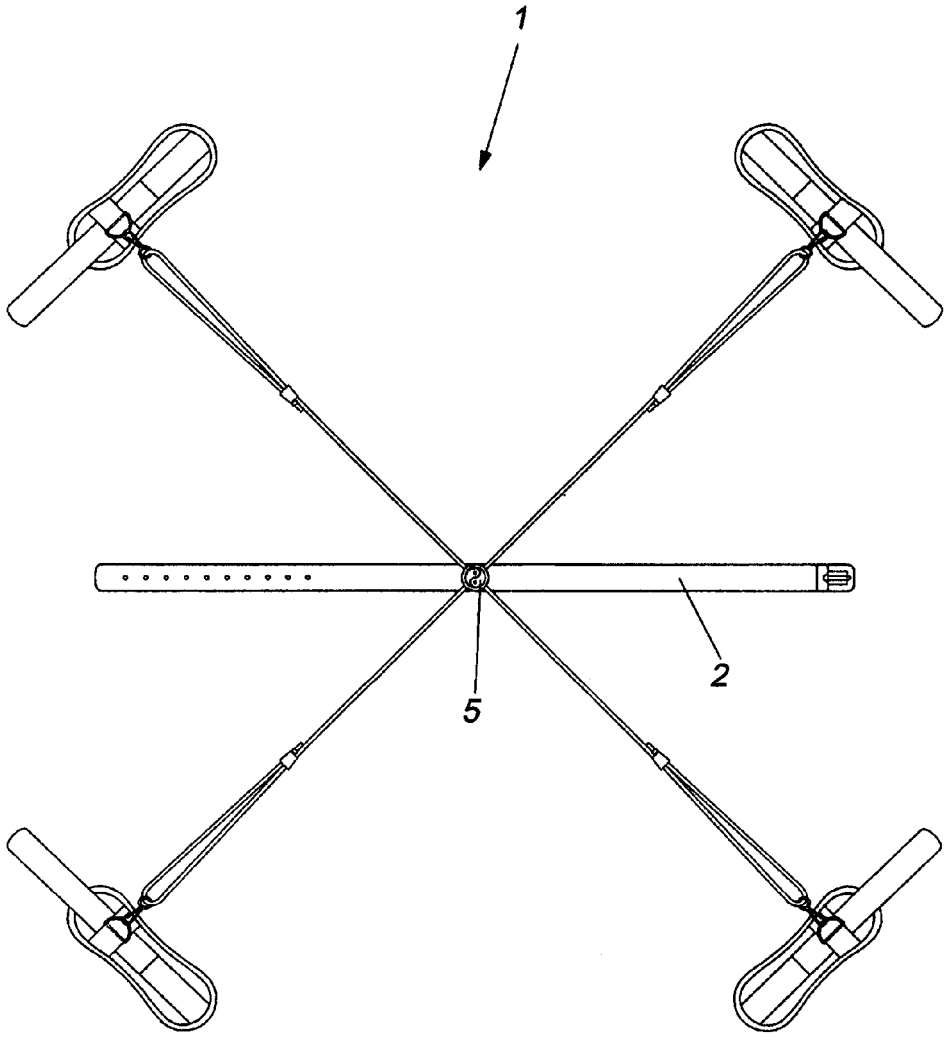
FIG. 6 shows another preferred embodiment of assembly of the device of the present invention.
Figure 7:
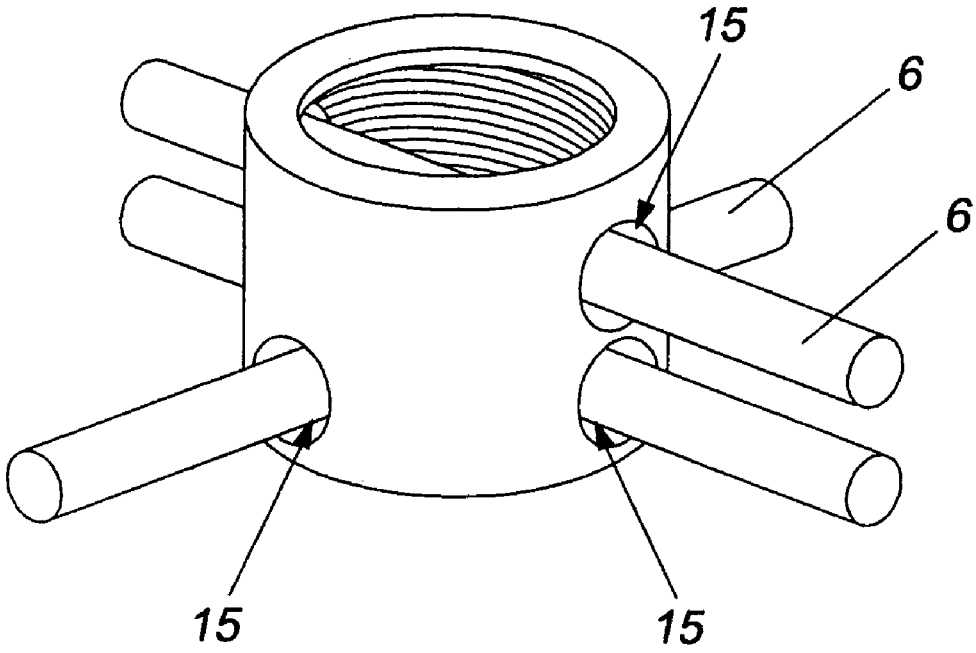
FIG. 7 shows a detail of the casing for the sliding passage component of the straps for the device of the present invention according to the assembly shown in FIG. 6.
Figure 8:
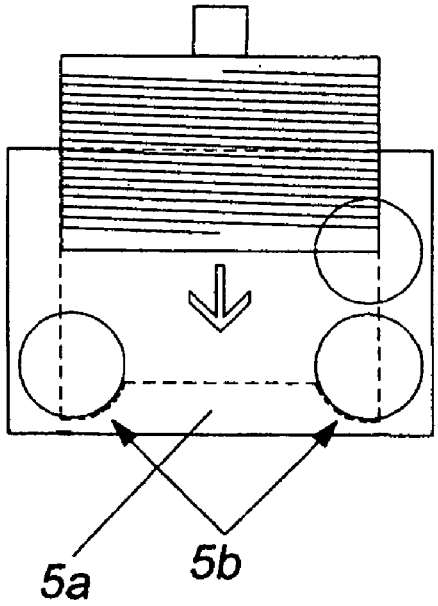
FIG. 8 shows a schematic lateral view of the casing of the sliding passage component for the straps of the device of the present invention according to the composition shown in FIG. 6.

In another preferred embodiment of assembling the invention, the peripheral holes are situated in two levels with respect to the axis of the case, with two holes brought face to face diametrically in less depth and four holes brought face to face diametrically two against two, out of phase 90°, correspondingly with two of them projected against the other two situated in less depth as shown in FIGS. 6 and 7. In this last instance the straps can cross each other at the interior of the case in a coplanar way or at different depths.

Having sufficiently described the nature of the invention, as well as the way to put it in to practice, it should be taken into account that the dispositions previously indicated and represented in the attached drawings are susceptible to modification of details on the condition that the fundamental principle will not be altered.

What is claimed is:

1. A device for performing physical activities that joins western and eastern theories and methodologies related to physical activities and health, the device comprising:

an adjustable belt, adjustable around an abdomen region of a user;

a sliding passage component provided on the belt, having an optionally engaged blocking system;

a plurality of elastic straps of adjustable length, slidable through the sliding passage component; and a removable fastening means affixed to an end of each of the elastic straps to fasten the straps to one or more extremities of the user;

wherein the sliding passage component comprises a case extending perpendicularly from an external side of the belt, the case having a threaded interior and a blind bottom area, and provided with a plurality of holes around a perimeter of the case for the straps to move through easily, the case further having a plurality of channels inside the case in the bottom area, extending from the holes along the bottom area for contacting the straps and facilitating the sliding movement of the straps; and wherein the blocking system comprises a threaded strangulating piston rod for coupling with the threaded interior, when engaged, restricts sliding movement of one or more of the straps, controlling free movement of the straps.

2. The device according to claim 1 wherein the piston rod is threaded until the straps are trapped against the channels of the case bottom, strangulating the straps and effectively immobilizing the straps.

3. The device according to claim 1 wherein the piston rod is threaded partially in the case, permitting free movement of the straps through the interior of the case.

4. The device according to claim 1 wherein the plurality of holes on the perimeter of the case are configured as two separate pairs of holes, the holes of each pair situated at a parallel level with respect to an axis of the case, wherein one pair of holes are located on an upper side of the case facing the user's head, the other pair of holes are located on a lower side of the case facing the user's feet.

5. The device according to claim 1 wherein the plurality of holes on the perimeter of the case are configured as six holes placed at two different parallel planes with respect to an axis of the case, wherein four of the holes are situated in parallel at a first plane, each of the four holes separated by 90°, and two of the holes are situated diametrically one in front of the other at a different plane parallel to the first plane.

6. The device according to claim 1 wherein the straps slide through the interior of the case in parallel and are able to cross each other outside the case at an upper side of the case or lower side of the case.

7. The device according to claim 1 wherein the straps enter the case and cross each other in a coplanar or non-coplanar configuration in the interior of the case.

8. The device according to claim 1 wherein when the straps are blocked, there is independent movement in the user's extremities.

9. The device according to claim 1 wherein when the straps are in an unblocked state, the movement of at least two of the user's extremities relate with each other.

10. The device according to claim 1 having two straps that cross each other resulting in each of an upper extremity relating to the movement of a lower extremity.

11. The device according to claim 1 wherein one of the straps corresponds to the movement between upper extremities and another strap corresponds to the movement between lower extremities.

12. The device according to claim 1 wherein movement of one of the straps relates an upper extremity with a lower extremity of the same side of the user's body and movement of another strap relates an upper extremity with a lower extremity of the other side of the user's body.

13. The device according to claim 1 wherein the sliding passage component is configured to accommodate straps of differing thickness for regulating levels of training efforts.

14. The device according to claim 1 wherein each strap is looped at the strap end, forming a loop to which the removable fastening means is connected, and further comprising one or more buckles located on a corresponding strap at a point where the loop closes, wherein a length of the strap is adjustable by the buckle.

15. The device according to claim 14 further comprising a hook attached to the loop of each strap end for affixing the corresponding removable fastening means to the extremity of the user.

16. The device according to claim 14 wherein the loop of the strap end is affixed directly to the corresponding removable fastening means of each of the extremities.

17. The device according to claim 14 wherein the fastening means further comprises a ring for connecting to the loop at the end of each strap.

18. The device according to claim 1 wherein the fastening means comprises small cushions adjustable by means of fastening strips.

19. The device according to claim 18 wherein the fastening strips comprise an adhesive curl.

* * * * *